United States Patent [19]

Garvey

[11] 4,390,860

[45] Jun. 28, 1983

[54] ELECTRONICALLY VARIABLE RESISTANCE DEVICE

[76] Inventor: Steven E. Garvey, 18288 Highway 9, Boulder Creek, Calif. 95006

[21] Appl. No.: 286,242

[22] Filed: Jul. 23, 1981

[51] Int. Cl.[3] ..... H01C 10/02

[52] U.S. Cl. ..... 338/38

[58] Field of Search ..... 338/80, 27, 38, 44, 338/94, 222, 156; 323/296

[56] References Cited

U.S. PATENT DOCUMENTS

| | | | |
|---|---|---|---|
| 1,745,447 | 2/1930 | Pesout | 323/296 |
| 3,900,816 | 8/1975 | Kiyono | 338/116 |
| 4,165,952 | 8/1979 | Bennett | 417/207 |

*Primary Examiner*—C. L. Albritton
*Attorney, Agent, or Firm*—Katharine Ku

[57] ABSTRACT

A variable resistance device having a moveable globule of liquid metal, contained in a channel, and having contact on one side with a resistive surface and on another side with a conductive surface, the resistive surface and conductive surface isolated from each other. The globule is moved by pumping a fluid through the channel, using a bi-directional fluidic pump whose pumping action is caused by selectively heating an adsorbent material. Selective heating is accomplished with a resistive material, dissipating power and controlled electronically.

6 Claims, 3 Drawing Figures

ELECTRONICALLY VARIABLE RESISTANCE DEVICE

This invention relates to a variable resistance device, and more particularly to a low-cost, compact, electronically variable resistance device.

As electric circuitry becomes more and more elaborate and complex, calibration becomes increasingly difficult. In particular, instruments in remote locations (e.g., microwave stations, satellites) or hard-to-reach places (e.g., inside complicated video and radio systems, sophisticated medical instruments, elaborate automotive control circuits) need to be calibrated since most circuits tend to drift. However, presently available methods of calibration, especially remote calibration, involve expensive, bulky requirement, and usually require extensive time and experience on the part of a technician.

What is needed is an inexpensive, compact and simple variable resistance device which can be used to calibrate complex circuits easily.

A principal object of this invention is to provide a variable resistance device which is electronically alterable.

Another object of this invention is to provide a variable resistance device which will provide any degree of sensitivity needed for a particular application.

A further object of this invention is to provide a variable resistance device which can be operated remotely.

A still further object of this invention is to provide a variable resistance device which is compact in size, inexpensive to manufacture and simple to use.

A still further object of this invention is to provide a variable resistance device which has no friction parts and therefore, no wear.

A still further object of this invention is to provide a variable resistance device having a fluidic pump for moving a conductive globule of liquid metal which acts as a moveable slider.

Briefly, in accordance with the invention, a variable resistance device is provided which employs a fluidic pump filled with heat adsorbent material, whose pumping action causes a globule of conductive liquid metal to move within a channel which has both a conductive and a resistive surface.

The invention and objects and features thereof will be better understood from the following detailed description and appended claims when taken in connection with the accompanying drawings in which:

Figure 1:
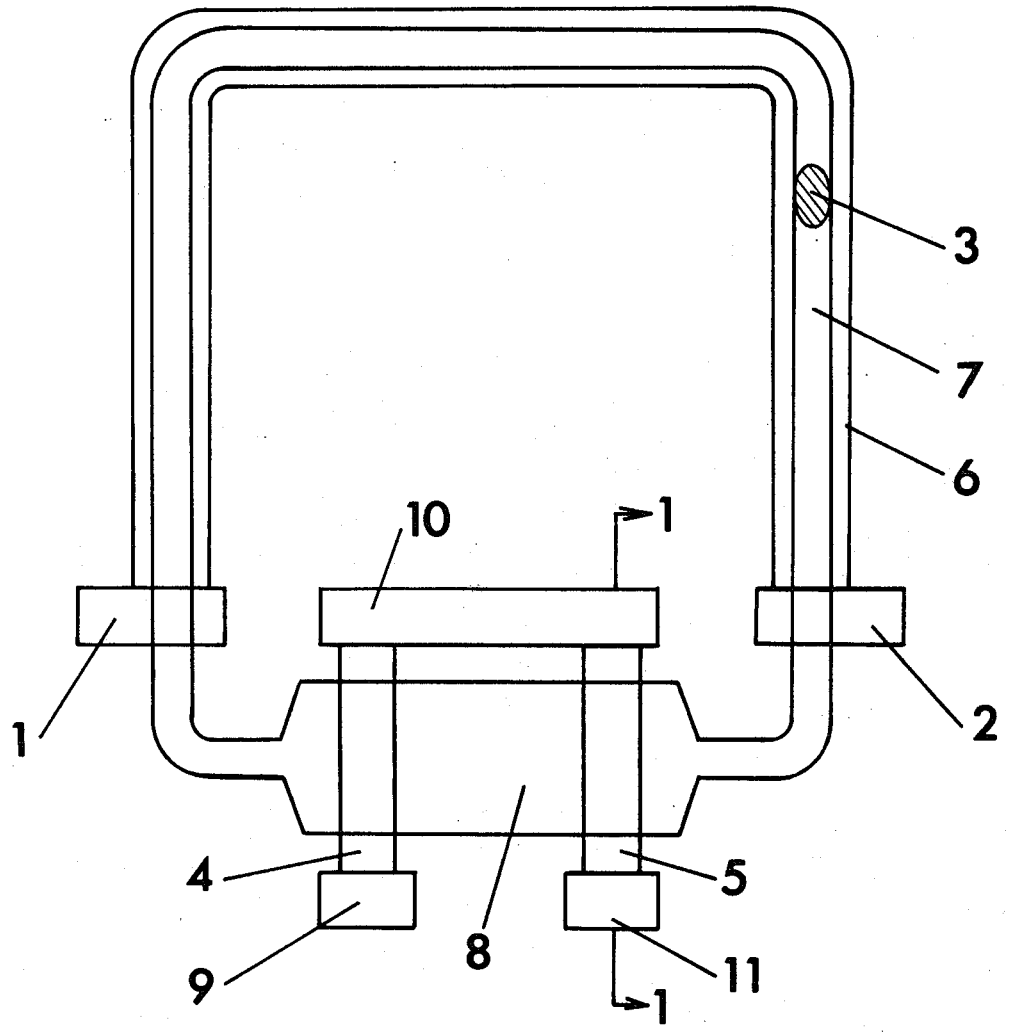
FIG. 1 is a top view of one embodiment of the variable resistance device.

Referring now to the drawing, FIG. 1 is a top view of a variable resistance device formed on a nonconducting substrate in accordance with one embodiment of the invention. A channel 7 for containing a globule 3 of a highly conductive liquid metal such as mercury is connected to a bi-directional fluidic pump 8 to form a continuous path. Channel 7 has four surfaces: a primary resistor bottom surface 6, an opposite conductive wall for allowing direct contact with the globule, and two opposing nonconductive surfaces isolating the conductive wall from the primary resistor wall. The channel may be 1–10 mils deep, 5–20 mils wide; the dimensions are limited only to a size which will allow the globule to stay intact. It will be appreciated that the channel may have recessed walls formed by standard chemical etching, lithographic, electron beam techniques, or have raised walls formed by standard deposition or layering techniques.

The shape, length and geometry of the channel is not critical to the invention as long as the resistive portion of the channel is isolated from the conductive portion.

Channel 7 is connected to bi-directional fluidic pump 8 which contains a heat adsorbent material such as zeolite, charcoal, or vicor. The pump can be equal in depth to, but can be wider than, channel 7 (e.g., 1–25 times wider) in order to maximize the flow rate in channel 7. Fluidic pump 8 is connected to resistive heater elements 4 and 5.

The continuous path formed by channel 7 and bi-directional fluidic pump 8 contains a high specific-heat capacity fluid such as ethylene glycol which is adsorbed/desorbed by the heat adsorbent material in the pump. The fluid moves the globule of liquid metal as it is adsorbed/desorbed.

Metal traces 1 and 2 are electrical contacts to the primary resistor 6. Metal traces 9, 10 and 11 are the electrical contacts to the resistor heater elements 4 and 5. Metal traces 1, 2, 9, 10 and 11 are printed, etched, or deposited on the substrate using standard techniques.

Figure 2:
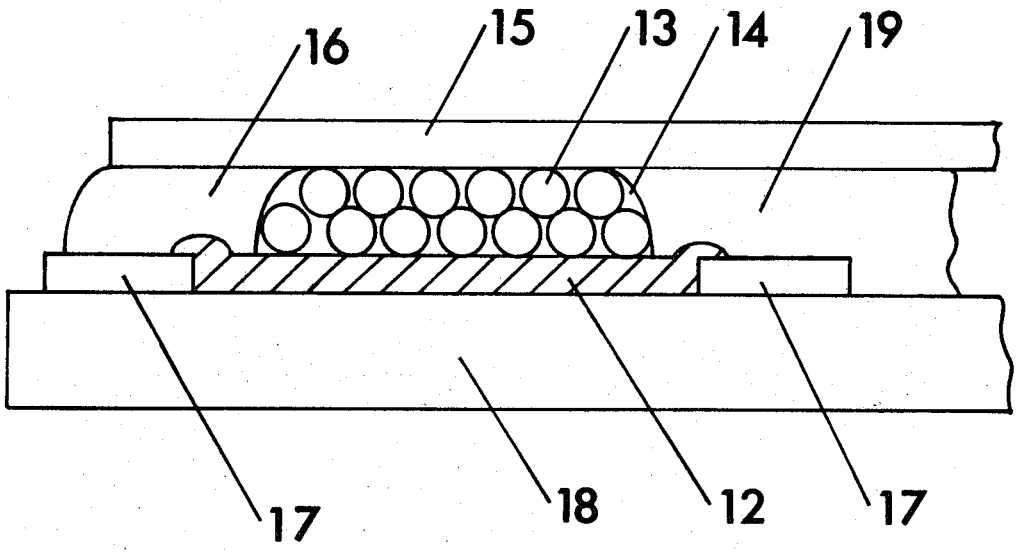
FIG. 2 is a cross-sectional view of the embodiment taken along line 1—1 of FIG. 1.

FIG. 2 is a cross-sectional view of fluidic pump 8. Using standard integrated circuit processing technology, thick film resistor 12 and metal trace 17 are deposited on a nonconducting substrate 18 such as glass, ceramic, fiber glass, or plastic. Nonconducting surfaces 16 and 19 are formed with a laminate to form a channel 14. Adsorbent material 13 is deposited in channel 14. A conducting wall 15 covers the device.

In an illustrative example, resistor heater element 4 is selectively heated with an electrical current controlled electronically with an open-collector type driver gate, a transistor, or a relay. As the current flows through the resistor heater element 4, heat is generated, thereby heating the adjacent side of the fluidic pump 8 and creating a temperature gradient. With a temperature gradient such as 50° to 100° C., the high specific-heat capacity fluid will be desorbed from the hot end of the adsorbent material in the fluidic pump, the fluid will move through channel 7, and be adsorbed at the cold side of the pump. The flow of fluid through channel 7 moves the liquid metal globule. The change in the position of the globule varies the point at which electrical contact is made with the primary resistor 6; therefore, the resistance is variable.

Figure 3:
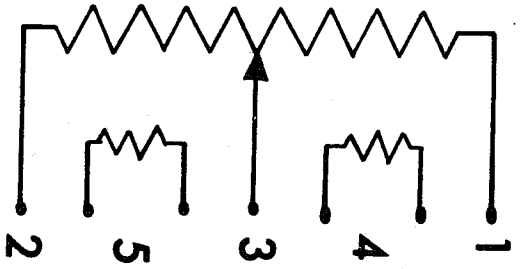
FIG. 3 is an electrical schematic representation of a variable device constructed after the teaching of this invention.

FIG. 3 is an electrical schematic representation of the invention. Terminals 1 and 2 are contacts to the primary resistor of the invention; 3 is the slider contact formed by the liquid metal globule and the conducting surface. Terminals 4 and 5 are the resistive heater elements.

The total dimensions of the invention may be 50–300 mils squared, more particularly the size of a mini-dual-in-line package. The variable resistance device is made by using standard processing techniques. It contains no friction parts and therefore, there will be no wear. The sensitivity of the device can be varied, depending on the design (i.e. length, type of resistor, size of the device, size of the globule) so that any degree of sensitivity can be obtained.

What is claimed is:

1. A variable resistance device comprising:

a channel having a continuous resistive portion isolated from a continuous conductive portion;

a moveable conductive liquid globule contained in said channel;

means for moving said globule in response to an electric current.

2. A variable resistance device described in claim 1 wherein said moving means comprises:

a. a fluidic pump connected to said channel containing a heat adsorbent material;

b. a fluid contained in said channel and said fluidic pump for moving said metal globule; and c. means for electrically heating said fluidic pump.

3. A variable resistance device described in claim 2 wherein said heat adsorbent material is zeolite.

4. A variable resistance device described in claim 2 wherein said fluid for moving said metal globule is ethylene glycol.

5. A variable resistance device described in claim 2 wherein said moveable conductive liquid metal globule is mercury.

6. A variable resistance device described in claim 2 wherein: said heat adsorbent material is zeolite, said fluid for moving said metal globule is ethylene glycol and said moveable conductive liquid metal globule is mercury.

* * * * *